US008006634B2

(12) United States Patent
Shishido

(10) Patent No.: US 8,006,634 B2
(45) Date of Patent: Aug. 30, 2011

(54) WHISTLE

(76) Inventor: Hideomi Shishido, Hiroshima (JP)

( * ) Notice: Subject to any disclaimer, the term of this patent is extended or adjusted under 35 U.S.C. 154(b) by 233 days.

(21) Appl. No.: 12/431,103

(22) Filed: Apr. 28, 2009

(65) Prior Publication Data

US 2009/0272310 A1 Nov. 5, 2009

(30) Foreign Application Priority Data

May 1, 2008 (JP) ..... 2008-119972

(51) Int. Cl.
*G10K 5/00* (2006.01)

(52) U.S. Cl. ..... 116/137 R; 446/204

(58) Field of Classification Search ..... 116/137 R; 446/202–206
See application file for complete search history.

(56) References Cited

U.S. PATENT DOCUMENTS

| | | | | |
|---|---|---|---|---|
| 2,754,714 | A * | 7/1956 | Folsom | 84/330 |
| 3,432,804 | A * | 3/1969 | Beeken | 116/137 R |
| 3,911,858 | A * | 10/1975 | Goodwin | 116/137 A |
| 5,086,726 | A | 2/1992 | Sharp | |
| 5,329,872 | A | 7/1994 | Wright | |
| 5,341,762 | A * | 8/1994 | Petersen | 116/137 A |
| 5,546,887 | A * | 8/1996 | Cameron | 116/137 R |
| 6,837,177 | B2 | 1/2005 | Tanaka | |
| 7,037,167 | B2 * | 5/2006 | Primos et al. | 446/204 |
| 7,428,878 | B2 * | 9/2008 | Kim | 116/137 R |
| 2002/0017231 | A1 | 2/2002 | Tanaka | |
| 2010/0261403 | A1 * | 10/2010 | Shishido | 446/204 |

FOREIGN PATENT DOCUMENTS

| | | |
|---|---|---|
| JP | 39-21231 | 7/1939 |
| JP | 2002-108345 A | 4/2002 |

* cited by examiner

*Primary Examiner* — R. A. Smith
(74) *Attorney, Agent, or Firm* — Gerald E. Hespos; Michael J. Porco

(57) ABSTRACT

An object of the present invention is to provide a whistle which has a resonance frequency shifted to the low-frequency side and a pleasant tone while retaining a compact size and light weight. In order to attain this object, a whistle comprises a mouthpiece portion, inside which an air passageway is formed and in which an air opening is opened, and a body portion, in which a connected resonance chamber that is connected to the air passageway is formed; the connected resonance chamber comprises a first resonance chamber, a second resonance chamber in which a sound-emitting opening is opened, and an orifice connecting the first resonance chamber and the second resonance chamber.

20 Claims, 9 Drawing Sheets

WHISTLE

BACKGROUND OF THE INVENTION

1. Field of the Invention

This invention relates to a whistle.

2. Description of the Related Art

Whistles are widely used by referees in various sporting events, for policing, guidance, and signaling where many people are gathered, as well as for guiding or training pets, and in numerous other fields as a simple tool for audio communication. A whistle must promptly convey sound to persons and animals in the environs, according to the various environments of use, and must excite their attention. For these reasons, a whistle-blower requires a whistle which can easily be held so as to enable prompt blowing as necessary. Moreover, listeners require a whistle emitting a sound with an easily discernible pitch and volume that can immediately be recognized. Whistles currently in use include pea-type whistles, having a pea which rotates within a resonance chamber, and pealess-type whistles, which have no pea. FIG. 9A shows a pea-type whistle 503, and FIG. 9B shows a pealess-type whistle 604.

A pea-type whistle 503 has as external dimensions a cylindrical body of diameter 19 to 20 mm×length of 17 to 20 mm, connected to a long, narrow rectangular parallelepiped-shape mouthpiece (length D 50 to 52 mm, height H 20 to 22 mm, width W 17 to 20 mm). Within this pea-type whistle 503 is a cylindrical resonance chamber of diameter 15 mm. This pea-type whistle 503 is normally blown while grasping the side faces of the cylindrical body.

On the other hand, the pealess-type whistle 604 has overall a long narrow box shape (with, as external dimensions, a length D of 51 to 54 mm, height H of 10 to 12 mm, and width W of 20 to 22 mm). This pealess-type whistle 604 is blown while grasping the side walls with the fingers.

In addition, the following inventions, adding improvements to the above general types of whistle, have been disclosed.

Japanese Patent Application Laid-open No. 2002-108345 discloses a whistle provided with a wall type deflector named air flow converter at the mouthpiece-side end of the orifice (the posterior end of the orifice), or at the mouthpiece-side end of the orifice and on the right and left of the orifice. In this whistle, the deflector changes the flow of air, to increase the higher harmonics. Specifically, by means of the deflector a negative-pressure region occurs on the lower side of this deflector, and the airflow amplitude is made large, to increase the high harmonics.

In U.S. Pat. No. 5,329,872, an all-weather type whistle is disclosed. This whistle has as an object use in water or in rainy weather. One end of the orifice upper portion of this whistle is covered by a semicircular cowling extending from the mouthpiece upper plate. When the orifice is thus surrounded by the cowling, air accumulates in the vicinity of the orifice in water, and so the passage of water through the orifice to enter into the resonance chamber is prevented. Moreover, this cowling prevents the ingress of rain. Further, the sound-emitting opening of this whistle is directed forward or downward.

Japanese Utility Model Laid-open No. S39-21231 discloses a volleyball referee whistle. In volleyball, in order to accurately observe play at the net, a referee sits on a referee's stand at a height of approximately 2 m, installed at a right angle to the net, to judge play. For this reason, whistle sounds must be emitted toward the players below. Hence the mouthpiece of this whistle is flexed downward in a circular arc, such that when held in the mouth the sound-emitting opening (orifice) is directed forward.

A whistle is a tool which utilizes a resonance phenomenon for blowing. Sound waves generated in the resonance phenomenon are the fundamental resonance frequency sound wave, and harmonic frequency sound waves at multiples of the fundamental resonance frequency. Hence the higher the fundamental resonance frequency, the higher the harmonic frequencies as well, and overall the sound wave generated is a higher-frequency sound. The fundamental resonance frequency is determined by the size of the resonance chamber. Specifically, the fundamental resonance frequency is inversely proportional to the size of the resonance chamber, and falls as the resonance chamber is made larger.

Based on the above-described dimensions, the fundamental resonance frequency of whistles of the prior art is from 3.3 to 3.5 kHz for pea-type whistles, and from 3.5 to 3.7 kHz for pealess-type whistles. Sounds at these frequencies, and sounds having harmonics based on these frequencies, are shrill and unpleasant sounds, and so improvement has been sought.

In response, increasing the size of the resonance chamber to lower the fundamental resonance frequency is conceivable. However, merely increasing the size of the resonance chamber fails to satisfy the need for a small and lightweight whistle, and is poor in terms of design as well. For example, in the case of the pea-type whistle 503 of the prior art described above, the cylinder diameter is increased to 35 to 40 mm, so that the whistle becomes large. Moreover, the whistles of the prior art give rise to the following problem.

In the whistles 503 and 604 of the prior art shown in FIG. 9A and FIG. 9B, air blown in from the air passageways 528 and 628 collides with the edges of the orifices 524, 624, and as a result sound waves are generated. A portion of the sound waves is selectively amplified by the resonance chamber 551, 651 through the resonance effect. The sound waves generated are immediately emitted to the outside from the orifices 524, 624. That is, in the whistles 503, 604 of the prior art, the orifices 524, 624 also serve as sound-emitting openings. These orifices (sound-emitting openings) 524, 624 are directed upward. As a result, as indicated by the arrows in FIG. 9A and FIG. 9B, the sound waves are emitted in radial form from the orifices 524, 624. The distance from the mouth to the ears for humans is generally approximately 15 cm. Hence sound waves leaving the orifices 524, 624 reach the ears 52 of the whistle-blower directly. As a result, in the case of the whistles of the prior art the whistle-blower must listen to the sound at high volume, normally approximately 120 dB/m, and at an unpleasant high frequency. This entails the possibility of affliction of the whistle-blower with a hearing disorder, or of ringing of the ears, or other problems. Even when such problems do not occur, sports referees and similar who blow whistles for extended periods of time may then not be able to hear sounds for some time thereafter. The lengths heights of the orifices 524, 624 in the sound emitting direction are stipulated by the thickness of the casing.

The whistle-blower normally holds the pea-type whistle 503 grasping the side faces of the cylindrical body. However, due to the circular shape of the side faces of the cylindrical body, the grasping angle is not readily determined. Further, the area to hold the whistle is insufficient. Hence there are problems such as failure of the whistle-blower to hold the whistle, or delays in blowing the whistle. The pealess-type whistle 604 also has a side face height which is only approximately half the size of the fingertips of an adult, and so has the problem of being extremely hard to hold.

To address these problems, in U.S. Pat. No. 5,086,726, a whistle is proposed which has side faces in a mandolin shape, of height 21 mm. If the overall dimensions are made large, the above problem can be resolved, but this fails to meet the need for a small and lightweight whistle.

In the case of the whistle of Japanese Patent Application Laid-open No. 2002-108345, the orifice also serves as a sound-emitting opening, and the shrill high-harmonic sound generated in the resonance chamber exists unmodified through the orifice. Consequently sounds generated by the whistle have amplified shrill high-frequency sounds and high harmonics, that is, high frequencies, and the sound is unpleasant. Also, because the orifice is directed upwards or downwards, high-frequency sound enters the ears of the whistle-blower directly. As a result, there is the problem that the whistle-blower may suffer a hearing disorder, or may feel ringing of the ears.

In the case of the whistle of U.S. Pat. No. 5,329,872, a semicircular cowling completely covers the top of the orifice. Consequently sound waves flowing out from the orifice all collide with the cowling, changing the sound waves to an acute angle in the propagation direction as sound waves are emitted from the sound-emitting opening. This change in propagation is 90° or 180° downward. In such a structure, the following problems occur.

First, due to the collision with the cowling and the change to an acute angle of the propagation direction, the energy loss of the sound waves is large, and the sound volume is greatly reduced. Second, because the sound-emitting opening is directed downward or forward, when using the whistle while grasping the side faces with the fingertips with the hand held below, the fingers and hand cover the sound-emitting opening, sound emission is impeded, and the sound volume is greatly reduced. Further, because the height of the cowling is high in order to prevent intrusion of water and rain, the cowling absorbs sound so that the sound volume is reduced, and so there is the problem that the original role of a whistle, which is to convey sound to distant listeners, is not achieved.

In the case of the whistle of Japanese Utility Model Laid-open No. S39-21231 also, grasping is difficult due to the narrow cylindrical shape, and moreover there is the problem that the hand blocks the sound-emitting opening, causing the sound volume to be reduced. Also, because the orifice also serves as the sound-emitting opening, there are the same problems as with other whistles of the prior art.

SUMMARY OF THE INVENTION

This invention was devised in light of the above problems, and has as an object the provision of a whistle which, while remaining compact and lightweight, shifts the resonance frequency to a lower frequency, and has a pleasant tone.

In order to attain this object, a whistle of this invention comprises a mouthpiece portion, inside which an air passageway is formed and in which an air opening is opened, and a body portion, in which a connected resonance chamber that is connected to the air passageway is formed; the connected resonance chamber comprises a first resonance chamber, a second resonance chamber in which a sound-emitting opening is opened, and an orifice connecting the first resonance chamber and the second resonance chamber.

According to this whistle, resonant sound waves are generated in both the first resonance chamber and the second resonance chamber. Further, resonant sound waves are generated in a connected resonance chamber that comprises the first resonance chamber and the second resonance chamber. The wavelength of sound waves resulting from this resonance is longer, and the resonance frequency is lowered without excessive enlargement of the whistle. Hence shrill and unpleasant high-frequency sounds are suppressed, and hardness of hearing or ringing of the ears of the whistle-blower is suppressed.

DETAILED DESCRIPTION OF THE PREFERRED EMBODIMENTS

First Embodiment

Figure 1:
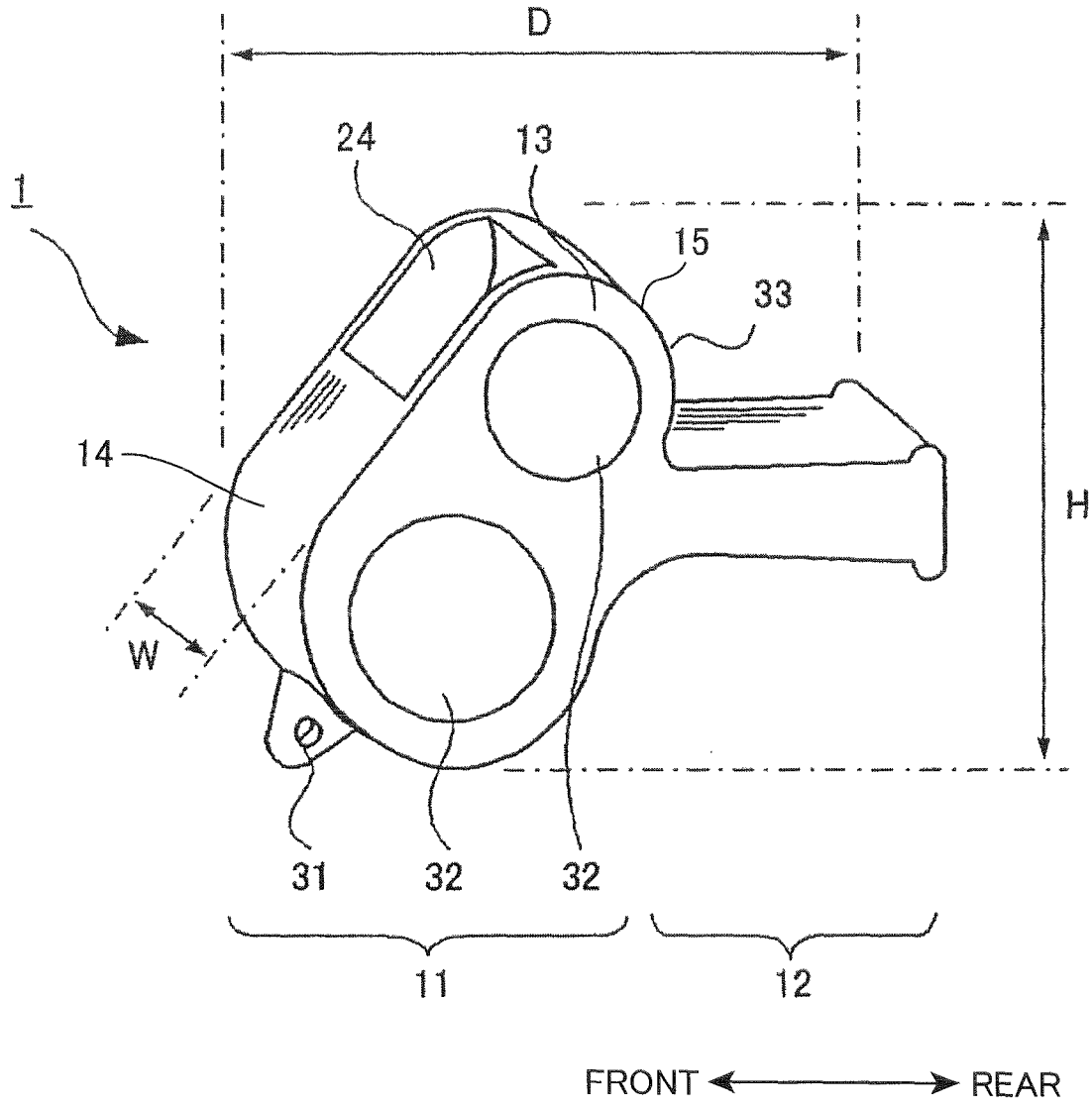
FIG. 1 is a perspective view showing the external appearance of the whistle of a first embodiment of the invention.
Figure 2:
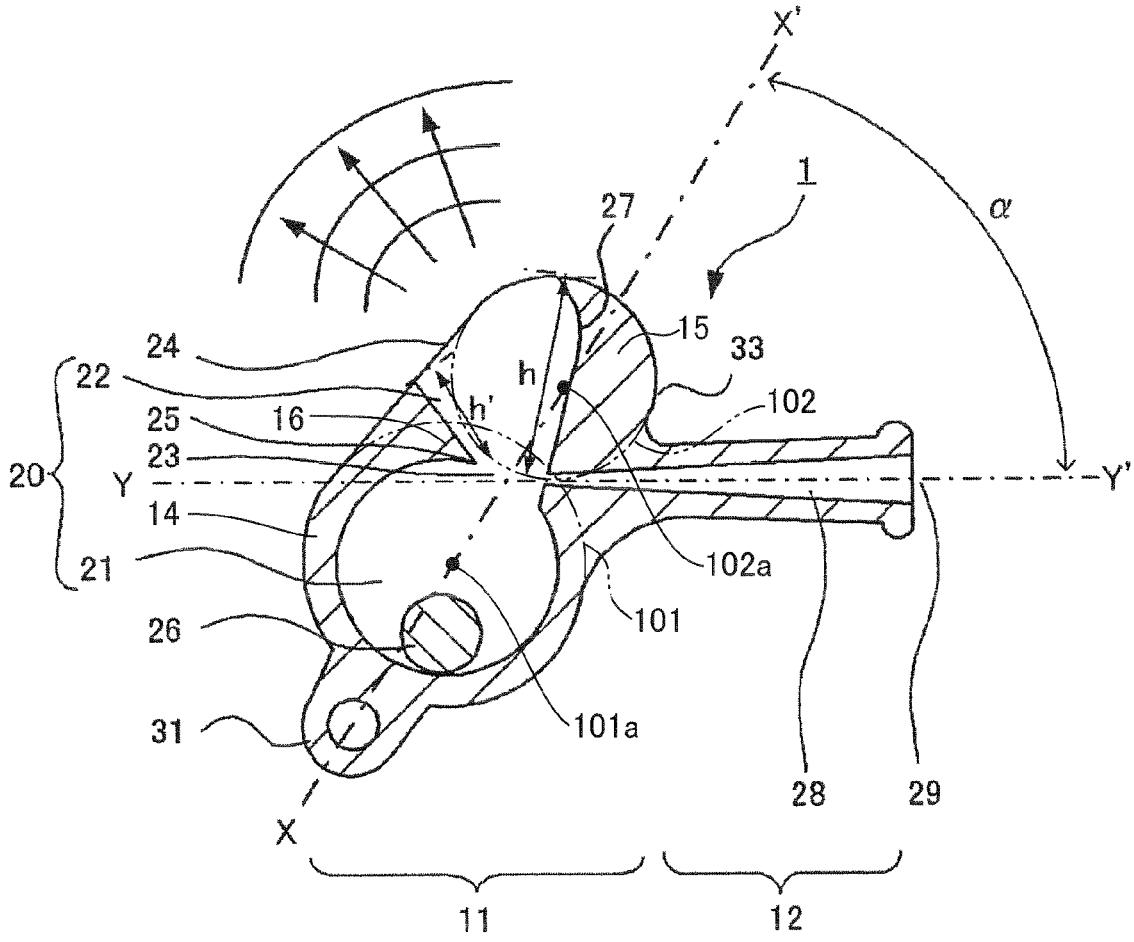
FIG. 2 is a cross-sectional view of the whistle of the first embodiment of the invention.

The whistle 1 of a first embodiment of the invention is explained, referring to FIG. 1 and FIG. 2. The whistle 1 is a so-called pea-type whistle. FIG. 1 is a perspective view showing the external appearance of the whistle 1. FIG. 2 is a cross-sectional view of the whistle 1.

The whistle 1 comprises a body portion 11 and a mouthpiece portion 12.

The body portion 11 has a vertically long and narrow shape. This body portion 11 has a connected resonance chamber 20. The body portion 11 has right and left side plates 13, extending in the vertical direction and forming the connected resonance chamber 20; a front wall 14, extending horizontally on the front side between these side plates; and a rear wall 15, extending horizontally between these side plates. The connected resonance chamber 20 comprises a first resonance chamber 21, a second resonance chamber 22, and an orifice 23. The front face, that is, the outside face of the front wall 14 of the body portion 11 is inclined forward and downward. In the upper-side portion of this front wall 14 is opened a sound-emitting opening 24. This sound-emitting opening 24 is formed on the upper side of a line extended from the mouthpiece portion 12. In other words, the lower end of this sound-emitting opening 24 is above the upper end of the mouthpiece portion 12.

More specifically, concave grips 32 conforming to the shape of human fingers are provided on the right and left side plates 13 of the body portion 11. By placing fingers on these grips 32, the whistle-blower can easily hold the whistle 1. Further, a holder 31 having a penetrating hole is provided at the body portion 11. By passing a string through this penetrating hole, the whistle-blower can suspend the whistle 1 from the neck.

The mouthpiece portion 12 is the portion held in the mouth of the whistle-blower. As shown in FIG. 2, this mouthpiece portion 12 has a substantially rectangular shape in horizontal cross-section, extending in the front-rear direction. The front end of this mouthpiece 12 is connected to substantially the vertical center portion of the rear wall 15 of the body portion 11. In the interior of this mouthpiece 12 is formed an air passageway 28. One end (the outer end or rear end) of this air passageway 28 opens in the rear face of the mouthpiece 12 as the air opening 29. The other end (the inner end or front end) of this air passageway 28 is connected to the connected resonance chamber 20 of the body portion 11. Air blown in from the air opening 29 is introduced into the connected resonance chamber 20 via the air passageway 28.

The right and left side plates 13 of the body portion 11, i.e., the vertical section of the body portion 11, has substantially an elliptical shape in the side view. Spherically, as shown in FIG. 2, the elliptical shape of the side plates 13 is defined by connecting a first circle 101 having a center 101*a* in a lower part of the body portion 11 and a second circle 102 having a center 102*a* in an upper part of the body portion 11 by a front tangent line and a rear tangent line. The first and second circles 101 and 102 are shown by the dot-dot-dash lines. The center 102*a* of the second circle is positioned closer to the mouthpiece portion 12 than the center 101*a* of the first circle 101. In other words, a line connecting the centers 101*a* and 102*a* or the length-direction axis of the side plate 13 is inclined upwardly toward the mouthpiece portion 12. The angle $\alpha$ made by the axis X-X' (hereafter called the "body axis"), which is the axis line connecting both ends of the body portion 11 in the length direction, and the mouthpiece axis Y-Y' in the length direction of the mouthpiece portion 12, that is, along the direction of air flow in the air passageway 28, is set to 30° to 70°. It is preferable that this angle $\alpha$ be set to 50° to 70° as appropriate.

In a case in which the angle $\alpha$ was 30° or less, the sound-emitting opening 24 would approach a state of facing directly upward. Hence similarly to whistles of the prior art, the whistle-blowing sound waves would wrap around and directly reach the ears of the whistle-blower. On the other hand, in cases in which the angle $\alpha$ is 70° or greater, the sound-emitting opening 24 approaches the Y side or the front of the user. Hence in a gymnasium or other indoor environment, reflection of sound waves by the ceiling would be reduced.

The front wall 14 of the body portion 11 has a protruding portion 16 which protrudes to the rear side in substantially the center in the vertical direction. The edge 25 of this protruding portion 16 opposes the portion of the rear wall 15 of the body portion 11 connected to the mouthpiece portion 12, that is, the portion at which the air passageway 28 opens.

The inside face of the front wall 14 of the body portion 11 is on a front rising inclination and flat in a region from the edge 25 of the protruding portion 16 to a position above the upper end of the mouthpiece portion 12. On the other hand, the inside face of this front wall 14 is curved frontward in moving downward from below the edge 25, and then curves rearward in a circular-arc shape. The inside face of the rear wall 15 of the body portion 11 is inclined upward and to the rear above the portion at which the air passageway 28 is opened opposing the edge 25. On the other hand, the inside face of this rear wall 15 is curved rearward in moving downward from below the center portion in the vertical direction, and then is curved frontward in a circular-arc shape.

The second resonance chamber 22 is formed upward (X' side) from substantially the center portion in the vertical direction of the body portion 11, that is, from near the point of intersection of the body axis and the mouthpiece axis. As stated above, the body portion 11 has a long narrow shape in the vertical direction. Hence the second resonance chamber 22 has a large volume.

The second resonance chamber 22 is formed by an inside face inclined to the front and upward above the edge 25 of the front wall 14, and an inside face inclined to the read and upward above the portion of the rear wall 15 at which the air passageway 28 opens; the cross-section as seen from the side has substantially a trapezoidal shape opening outward toward the sound-emitting opening 24. As mentioned above, the lower end of the sound-emitting opening 24, i.e., the upper end of the front wall 14 of the body portion 11, is above the upper end of the mouthpiece portion 12, so that the second resonance chamber 22 has the sufficient dimension in the vertical direction.

On the other hand, the first resonance chamber 21 is formed by a circular arc-shape inside face below the edge 25 of the front wall 14 below the second resonance chamber 22 in the body portion 11, and a circular arc-shape inside face below the portion of the rear wall 15 at which the air passageway 28 opens, and has a cylindrical shape extending in the horizontal (left-right) direction.

The inside face above the rear wall 15 forming the second resonance chamber 22 is curved gently frontward at the top portion 27.

A pea 26 is accommodated within the first resonance chamber 21. This pea 26 performs circular motion within the cylindrical first resonance chamber 21, due to the flow of air which has flowed into the first resonance chamber 21. As a result of periodic blocking of the orifice 23 during the circular motion of this pea 26, a so-called beat sound is generated by the whistle 1 of this embodiment.

In the portion connecting the first resonance chamber 21 and second resonance chamber 22 is formed an orifice 23 that has a slit shape, of narrower width in the front-rear (Y-Y') direction than the first resonance chamber 21 and second resonance chamber 22. In this embodiment the width and the length thereof are set to approximately 5 mm and to approximately 15 mm respectively. This orifice 23 is in a position which is in the upper end of the first resonance chamber 21 and closer to the mouthpiece portion 12.

In this way, in the whistle 1 of this embodiment, each member is arranged efficiently in two dimensions (in the front-rear and vertical direction), the efficiency of use of space is high, and a second resonance chamber 22 having large volume is realized while retaining the small size and light weight required of the whistle.

Further, as described above, the body portion 11 has an inclined shape which, moving upward, approaches the mouthpiece portion 12, so that the rear portion of the body portion 11 protrudes toward the air opening 29 and functions as a stopper 33 for the upper lip. In this way, a stopper 33 for the upper lip can be realized without increasing the size of the whistle 1.

Because in the prior art each member is arranged continuously in one dimension in a linear shape, if the resonance chamber is made larger to lower the resonance frequency, the overall whistle size is increased. However, by adopting the above-described structure with high efficiency of space utilization for the whistle 1 of this first embodiment, the resonance frequency can be lowered without increasing the overall size of the whistle.

Next, action of the whistle is explained in detail. As is well known, a whistle is a tool which utilizes a resonance phenomenon. The principle of whistle-blowing is explained as follows. A flow of air blown in from the air passageway collides with an orifice edge, and forms various eddies. These eddies cause the air to vibrate, generating sound comprising various frequencies. Among these sounds, sounds which match a resonance frequency determined by the size and shape of the resonance chamber are amplified as so-called standing waves (that is, as fundamental resonance frequency sound waves and harmonic waves thereof), to become an intense sound before being emitted from the sound-emitting opening. Here, the resonance frequency (blowing sound of the whistle) and the size of the resonance chamber are inversely proportional. That is, as is well-known in the field of musical instruments, as the resonance chamber is made larger, the resonance frequency becomes lower.

In the whistle 1 of the first embodiment, the sounds generated when the airflow blown in from the air passageway 28 collides with the edge 25 of the protruding portion 16 are affected by both the first resonance chamber 21, by the second resonance chamber 22 and the connected resonance chamber 20.

The first resonance chamber 21 has a cylindrical shape, with a diameter of 15 mm and length of 15 mm. On the other hand, the orifice 23 has a width of approximately 5 mm and length of 15 mm, and is not small enough to be neglected with respect to resonance in the whistle 1. Hence resonance in the whistle 1 is affected by the limited space (the second resonance chamber 22) communicating with the orifice 23. The effect of this influence is to increase the size of the resonance space. Consequently, sounds generated in the whistle 1 are sound waves at a still lower frequency than the resonance frequency determined by the size of the first resonance chamber 21 alone.

Resonance sound waves generated by the first resonance chamber 21 pass through the second resonance chamber 22 and are emitted from the sound-emitting opening 24. The second resonance chamber 22 has substantially a trapezoidal shape, opening outward, with heights h, h' from the orifice 23 to the sound-emitting opening 24 of from 5 to 15 mm. For this reason, the resonance sound waves do not undergo a sudden change in direction when passing through this second resonance chamber 22. Consequently, the acoustic energy of these resonance sound waves is not absorbed by the walls and attenuated. The upper-end portion 27 of the inside face of the rear wall 15 forming the second resonance chamber 22 is a gently curved surface as shown in the figure. As a result, the energy loss arising from collision with this portion 27 is small enough to be negligible.

Resonances occur in the space of the second resonance chamber 22 that opens downward at the orifice 23 and opens upward at the sound-emitting opening 24. Also, resonances occur in the space of the connected resonance chamber 20 that closes at the bottom end and opens upward at the sound-emitting opening 24. The former resonance of the second resonance chamber 22 itself creates a standing wave (described below) through repeated reflections between the orifice 23 and the sound-emitting opening 24, which are open ends. In the latter resonance of the connected resonance chamber 20, sound waves reflected at the sound-emitting opening 24 pass through the orifice 23 to reach the first resonance chamber 21, and are reflected at the wall to create a standing wave.

Because the second resonance chamber 22 has a trapezoidal shape of width 5 mm, length 15 mm, and height from 5 to 15 mm, the size is smaller than that of the first resonance chamber 21. Hence the resonance frequency of the sounds corresponding to the size of the second resonance chamber 22, among the various sounds created by the edge 25, is higher than the resonance frequency of the sounds corresponding to the first resonance chamber 21.

On the other hand, the connected resonance chamber 20 is an aggregate of the first resonance chamber 21 and the second resonance chamber 22. Hence the size of the connected resonance chamber 20 is greater than the size of the first resonance chamber 21 itself or the size of the second resonance chamber 22 itself. Consequently, the resonance frequency of the sounds, among the various sounds created by the edge 25, corresponding to the size of the connected resonance chamber 20, is clearly lower than the resonance frequencies occurring in each of the individual resonance chambers themselves. Owing to the provision of the second resonance chamber 22, the resonance sound waves in the whistle 1 are on the whole lower-frequency waves. These resonance sound waves generated in the second resonance chamber 22 itself and in the connected resonance chamber 20 are emitted obliquely upward and forward from the sound-emitting opening 24 without attenuation.

It is preferable that the second resonance chamber 22 have four side faces with heights of 5 to 15 mm each. If the heights of the side faces are 5 mm or less, the resonance frequency is 340 m/s/(5 mm×2)=34 kHz or higher, beyond the audible range, wherein 340 m/s is the speed of sound.

On the other hand, if the heights of the side faces are 15 mm or greater, then as indicated in an embodiment described below, there is no further lowering of the resonance frequency. That is, the overall whistle size is only made larger, and the original desideratum of a whistle which is compact and lightweight is not obtained. Also, it is desirable that the second resonance chamber 22 have a bugle shape, or a widening rectangular parallelepiped shape, extending substantially straight and directly upward from the orifice 25. If the second resonance chamber 22 is an enclosure which is bent at an acute angle, energy losses due to sound wave collisions and changes in direction are large, and there is considerable decline in sound volume.

The external dimensions of the whistle 1 of the first embodiment configured as described above are length D 47 mm, height H 25 mm, and width W 19 mm, substantially equal to those of a whistle 3 of the prior art. Despite the addition of a large second resonance chamber 22, excessive enlargement of the external dimensions could be suppressed due to the fact that the mouthpiece axis is inclined by an angle $\alpha$ with respect to the body axis, with the advantageous result that efficiency of utilization of space is improved. That is, in the prior art each member is arranged continuously in one dimension in a linear shape, so that if the resonance chamber is made larger to lower the resonance frequency, the overall whistle size is increased. However, by adopting the above-described structure with high efficiency of space utilization for the whistle 1 of this first embodiment, the resonance chamber can be made larger without increasing the overall size of the whistle. Moreover, as is clear from FIG. 1, the whistle 1 of the first embodiment has a novel design not seen in the prior art.

Figure 3A:
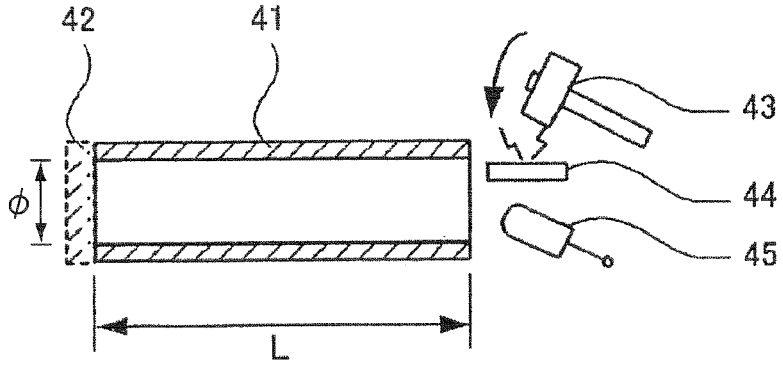
FIG. 3A is a summary view showing sound wave reflection experiments.

Next, experiments performed to confirm the existence of the phenomenon described above, in which sound waves are reflected at the sound-emitting opening 24, and return into the second resonance chamber 22 or the first resonance chamber 21 to cause resonance, are described. As shown in FIG. 3A, a hammer 43 and a microphone 45 were installed at one open end of a pipe 41 having both ends open. The hammer 43 was used to strike a solid object 44 to generate sound, and thereafter the change with time in the sound waves was measured.

Figure 3B:
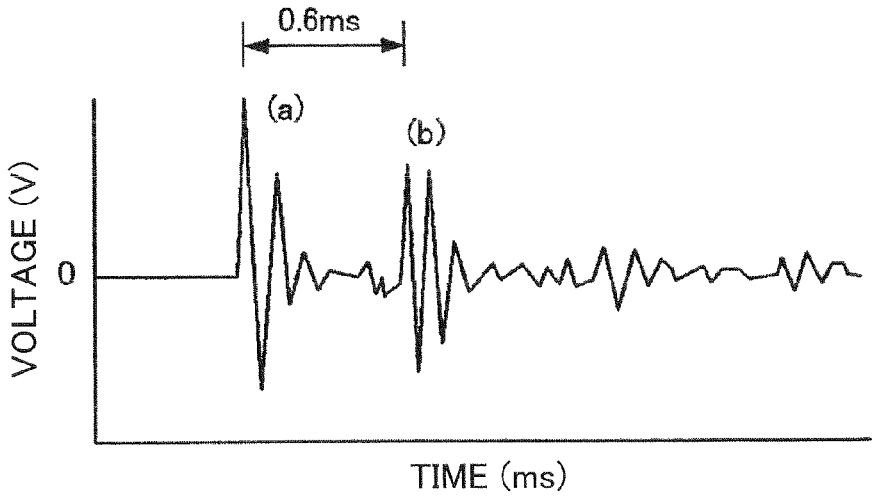
FIG. 3B is an output waveform at an open end.
Figure 3C:
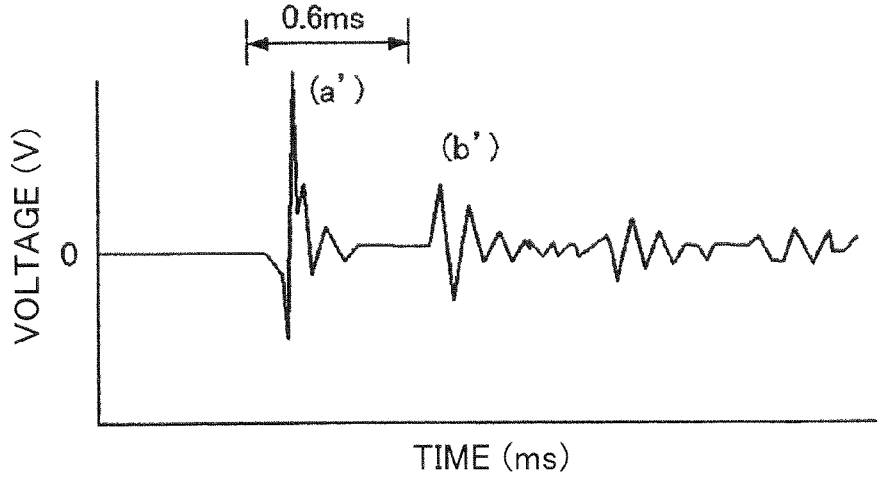
FIG. 3C is an output waveform at a closed end.

FIG. 3B and FIG. 3C show measurement results for experiments using a pipe 41 of length L 100 mm and diameter ϕ25 mm. FIG. 3B is a microphone output waveform for a case in which the other end was closed using a covering plate 42, indicated by a dashed line in FIG. 3A, as a closed end. FIG. 3C is a microphone output waveform for a case in which the other end was opened without being blocked by the covering plate 42, as an open end.

In both cases, the initial waveforms (a) and (a') are the sounds of striking with the hammer 43 themselves. The second and subsequent waveforms are reflected waves. The second wave (b) in FIG. 3B is the wave reflected at the closed end. The second wave (b') in FIG. 3C is the wave reflected at the open end.

From these experiments, it is seen that sound waves are reflected and return similarly for an open end and a closed end. More specifically, the amplitude of the return wave from the closed end is approximately 70% of that of the input sound wave. The amplitude of the return wave from the open end is approximately 45% of that of the input sound wave. In this way, even at an open end, adequate reflection, approximately 65% of that for a closed end, occurs.

A phenomenon similar to this occurs in the whistle 1 of this embodiment. That is, in the whistle 1 of this embodiment also, a portion of the sound waves advancing into the second resonance chamber 22 are reflected at the sound-emitting opening 24, which is an open end, and return into the second resonance chamber 22. And, a portion of the returning sound waves are reflected at the orifice 23, and again advance toward the sound-emitting opening 24. On the other hand, the remainder of the sound waves pass through the orifice 23 to enter the first resonance chamber 21, further causing the resonance phenomenon.

In this way, in the whistle 1 of the first embodiment, resonance of the second resonance chamber 22 and resonance of the connected resonance chamber 20 occur simultaneously. For the whistle 1 overall, three resonances occur, including the resonance of the first resonance chamber 21. And, in the whistle 1 of this embodiment, through intermixing of these three resonances, the frequency of the overall sound generated is shifted to the low-frequency side, to result in a fuller and more pleasant sound not obtained in the prior art, with disagreeable harmonics suppressed. Thus by means of the whistle 1 of this embodiment, whistle-blowing sounds can be generated at low frequencies compared with the prior art, and the problem of disagreeable harmonics is resolved.

Moreover, in the whistle 1 of the first embodiment, the connected resonance chamber 20 is formed with the body axis inclined with respect to the mouthpiece axis, so that conspicuous enlargement of the external dimensions of the whistle is avoided.

Also, in the whistle 1 of the first embodiment, the top portion 27 of the inside face of the rear wall 15 of the body portion 11, forming the second resonance chamber 22, is curved, and the direction of emission of sound waves is directed forward. Hence sound waves are emitted forward, and direct entry into the whistle-blower's ears of the sound waves is avoided. Further, sound waves directly reach listeners in front of the whistle-blower. Hence listeners can instantly recognize the whistle-blowing sound. Also, sound waves are shifted to the low-frequency side, for which there is generally little attenuation and which reach far distances, so that even distant listeners can recognize the whistle-blowing sound.

Further, in the whistle 1 of this embodiment, the side plates 13 of the body portion 11 extend on the sides of the air opening 29 and upward, so that compared with whistles of the prior art, the area of the side plates 13 is large. Consequently, the area which can be held during use is approximately doubled compared with whistles of the prior art, and together with the grips 32, the whistle-blower can very easily grasp the whistle 1.

Further, in the whistle 1 of this embodiment, the upper lip fits satisfactorily against the stopper 33 on the rear of the body portion 11. Hence the whistle-blower can hold the whistle in the mouth in a fixed state, even when the whistle 1 is rapidly placed in the mouth. Thus the whistle 1 of this embodiment is suited for use in refereeing of sports involving sudden movement.

As described above, the whistle 1 of this embodiment combines the functional improvement of alleviation of disagreeable high-frequency noise with such ergonomic improvements as reduced burden on the ears and ease of gripping, as well as a novel design, and so can be described as superior in all regards.

Second Embodiment

Figure 4:
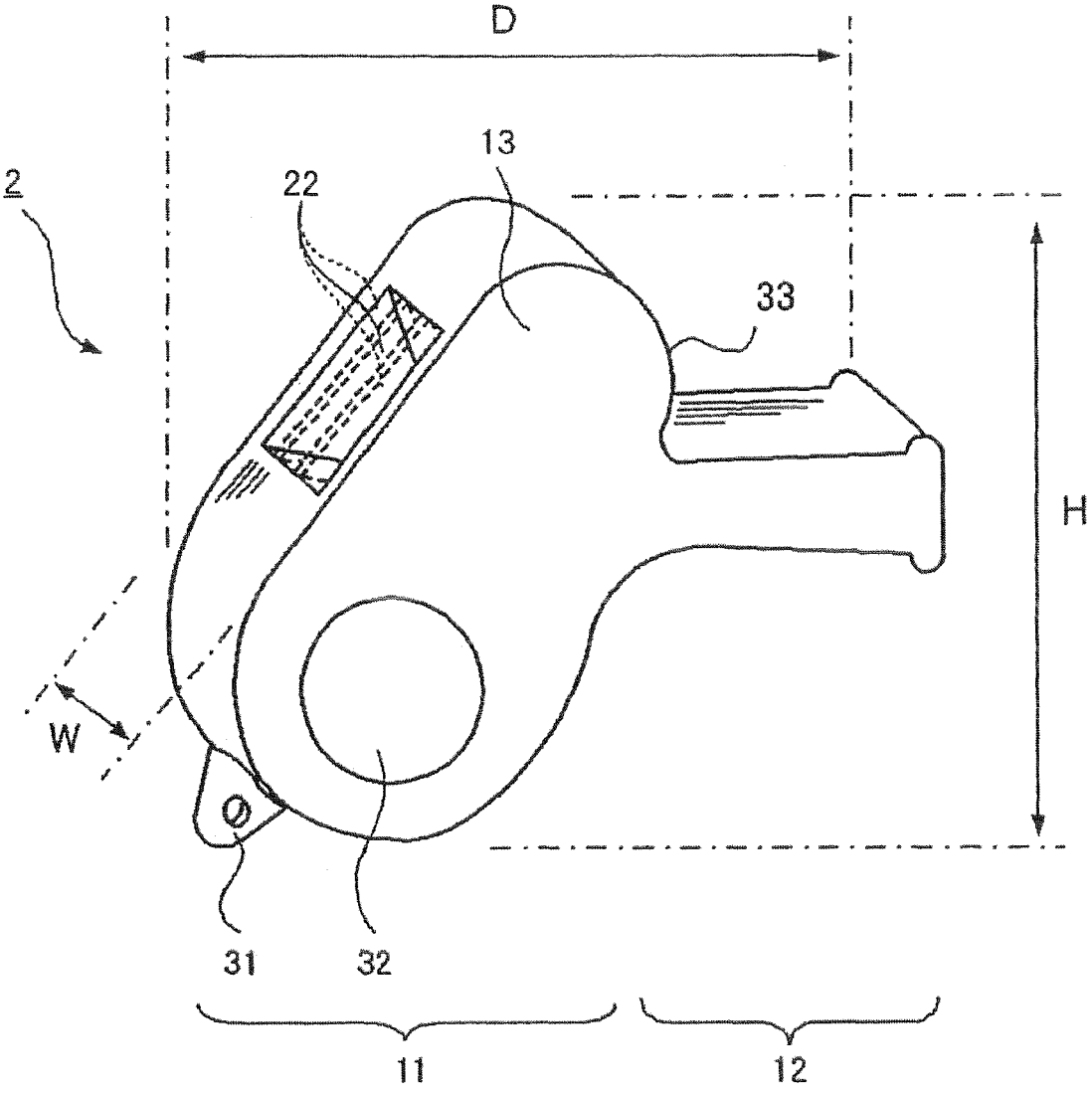
FIG. 4 is a summary view of the whistle of a second embodiment of the invention.
Figure 5:
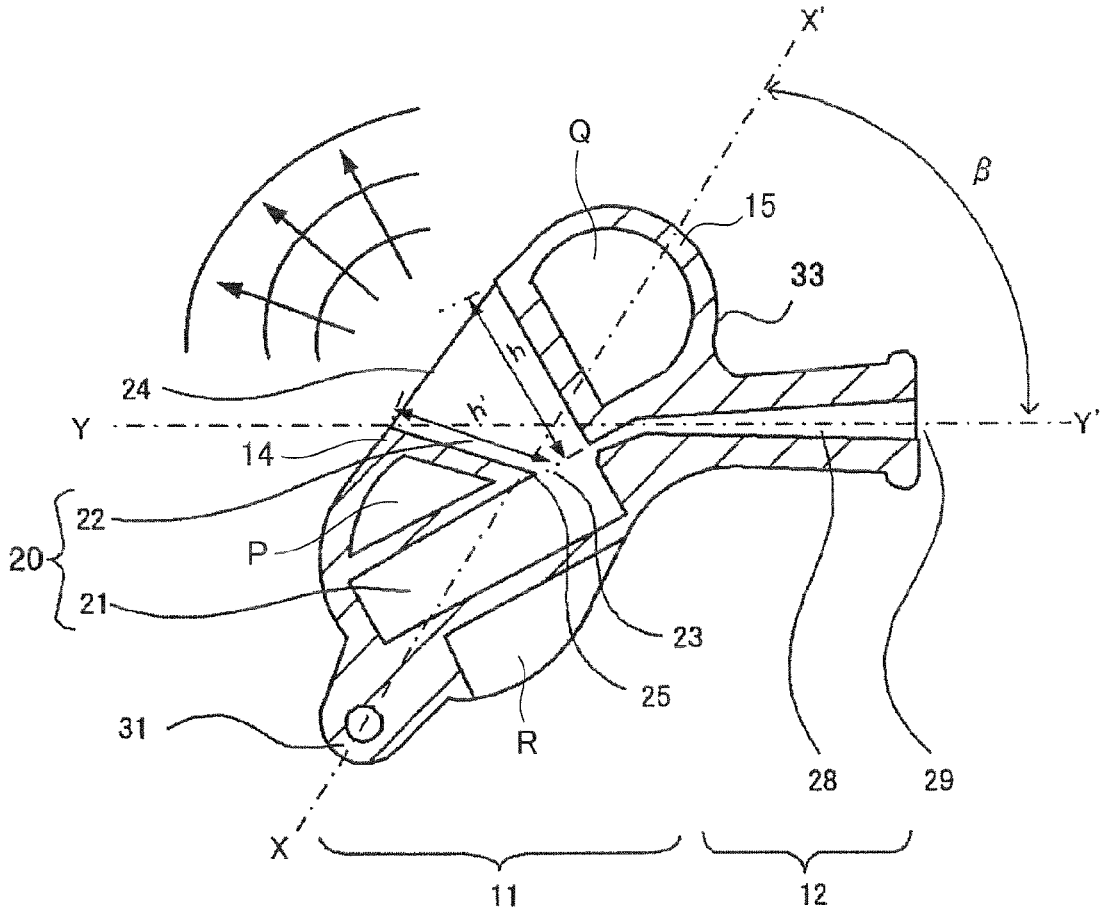
FIG. 5 is a perspective view showing the external appearance of the whistle of the second embodiment of the invention.

The whistle 2 of a second embodiment is explained, referring to FIG. 4 and FIG. 5. FIG. 4 is a perspective view showing the external appearance of the whistle 2, and FIG. 5 is a cross-sectional view of the whistle 2. The whistle 2 is a so-called pealess-type whistle.

Similarly to the resonance chamber of an ordinary pealess-type whistle, the first resonance chamber 21 is a rectangular parallelepiped-shape space. However, the first resonance chamber 21 of the whistle 2 of the second embodiment is inclined forward and downward.

The second resonance chamber 22 widens toward the sound-emitting opening 24, and the sound-emitting opening 24 opens in the front face of the body portion 11 formed forward and downward, and directs forward and upward. The air passageway 28 is flexed downward midway, and the front end of this air passageway 28 opens forward and slightly downward. The angle β made by the axis X-X' of the body portion 11 and the axis Y-Y' of the mouthpiece portion 12 is set to from 30° to 75°, and preferably from 50° to 70°. By inclining the body axis X-X' with respect to the mouthpiece axis Y-Y', the first resonance chamber 21 is arranged to be inclined. By thus inclining the first resonance chamber 21, a large second resonance chamber 22 is formed in addition to this first resonance chamber 21, without lengthening the overall length of the whistle 2, and while suppressing excessive enlargement of the external dimensions. Further, a large connected resonance chamber 20 is formed. Here, with the object of preventing unnecessary increases in weight and unsatisfactory resin molding, it is desirable that an unnecessary portion R remaining on the lower side faces of the first resonance chamber 21 of the body portion 11, and an unnecessary portion Q on the rear wall 15 and an unnecessary portion P on the front wall 14, be made hollow. A part of the front wall 14 which defines the unnecessary portion P may be omitted. A part of the rear wall 15 which defines the unnecessary portion Q may be omitted. A part of the side plates 13 which defines the unnecessary portion R may be omitted. The front wall 14 may be so shaped as to make the unnecessary portion P be smaller. The rear wall 15 may be so shaped as to make the unnecessary portion Q be smaller. The side plates 13 may be so shaped as to make the unnecessary portion R be smaller. With the configurations mentioned above, the whistle 1 may have more characteristic design.

Further, as indicated by the dashed lines in FIG. 4, the first resonance chamber 21 and the second resonance chamber 22 may each be partitioned by partitioning plates into two or three approximately in the horizontal direction or the widthwise direction to create small separate resonance chambers, so that the first resonance chamber 21 and second resonance chamber 22 each are compound resonance chambers comprising a plurality of small resonance chambers. And, the lengths of each of the small resonance chambers may be made different. By this means, as a result of the different resonance frequencies of each of the small resonance chambers, the whistle-blowing sounds of the whistle 2 are whistle sounds having so-called beat sounds, in which a plurality of tones are superposed. The small resonance chambers forming the first resonance chamber 21 are two or three in number, with different rectangular parallelepiped shapes, the height and width of which are both 6 mm, and the lengths of which are 20 mm, 19 mm, and 17.5 mm.

The external dimensions of the whistle 2 are length D 56 mm, height H 26 mm, and width W 21 mm, and are substantially the same as an improved type whistle of the prior art (U.S. Pat. No. 5,086,726), with the side plates made high for easy grasping. Despite the fact that a large second resonance chamber 22 is added, excessive enlargement of the external dimensions has been suppressed by inclining the mouthpiece axis Y-Y' by an angle β with respect to the body axis X-X', and raising the efficiency of space utilization. The whistle 2 of the second embodiment has a novel design not seen in the prior art, as is clear from FIG. 5.

Otherwise the configuration and action are similar to those of the whistle 1 of the first embodiment, and so an explanation is omitted.

Embodiment 1

Figure 9A:
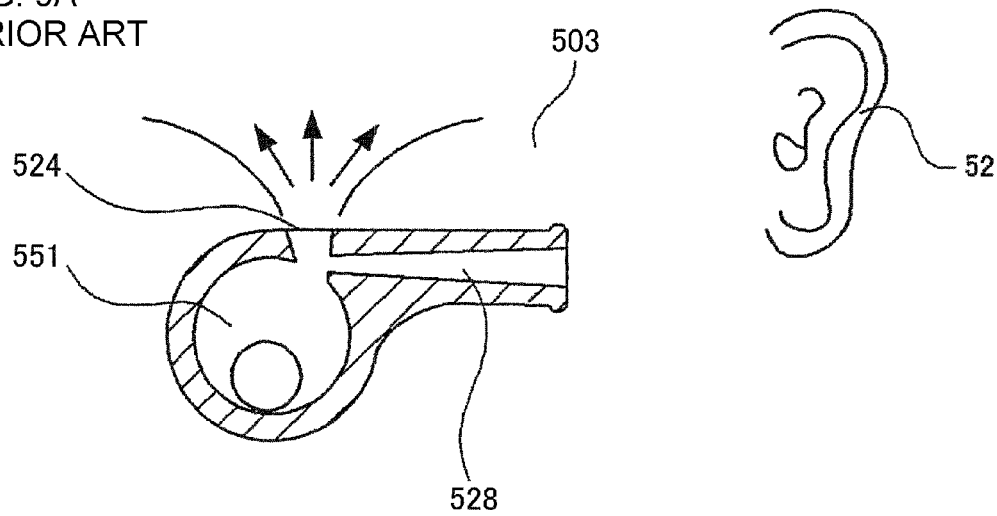
FIG. 9A PRIOR ART
FIG. 9A is a cross-sectional view of a pea-type whistle of the prior art.

A pea-type whistle 1 of the above first embodiment, and as a reference example a whistle the same size as this but with the second resonance chamber removed, that is, similar to the whistle 503 shown in FIG. 9A, were fabricated, and the frequency characteristics of each were measured. And, examination to determine whether there was a shift to the low-frequency side of sound waves of the whistle 1 of the first embodiment was performed. Also, an examination was performed to determine whether the resonance sound was increased and the sound had more richness. The heights of the second resonance chamber of the whistle of the first embodiment used in measurements were h=14 mm and h'=10 mm.

A sound-level meter was installed at a position 1 m forward from each of the whistles in an anechoic chamber. Compressed air corresponding to human exhalation was supplied to the air opening from a compressor, and differences in sound quality due to the presence or absence of the second resonance chamber were measured. The sound-level meter output was analyzed using a frequency analyzer. In these experiments, whistles with the pea removed were compared and measured. This was because, due to blocking of the orifice while rolling during rotation, the pea generates beat sounds. As will be seen below, beat sounds are unrelated to resonance phenomena, and moreover the frequency distribution thereof is not uniform. Hence if a pea is present, the power spectrum distribution waveform is complicated, and understanding is impeded.

Figure 6A:
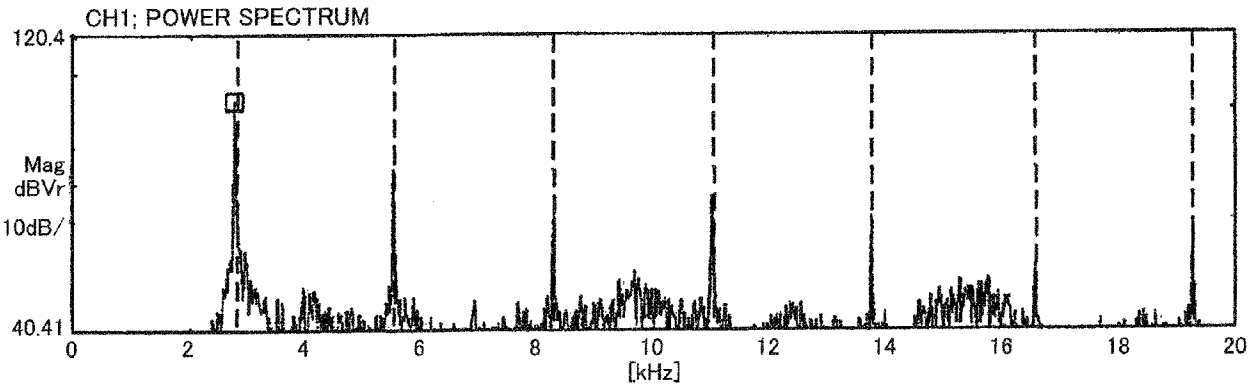
FIG. 6A is the power spectrum of the whistle of the first embodiment of the invention.
Figure 6B:
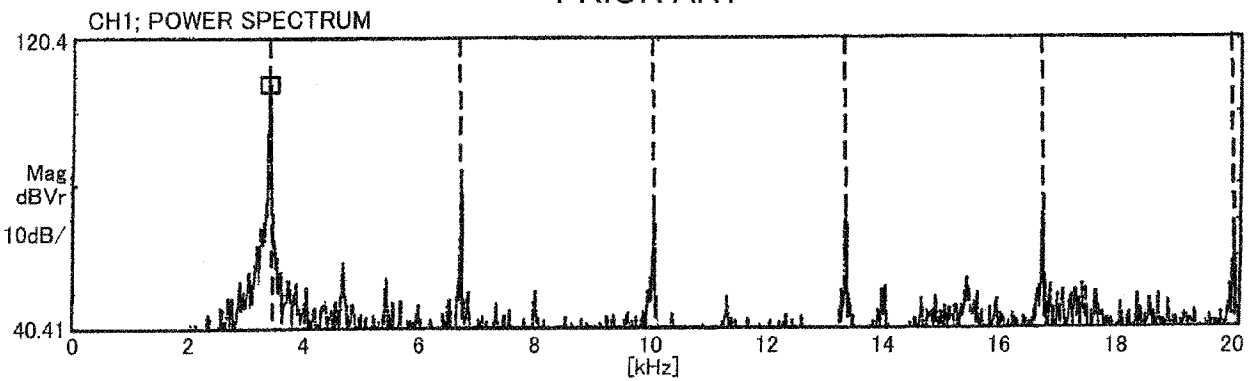
FIG. 6B PRIOR ART
FIG. 6B is the power spectrum of a whistle of the prior art.

Analysis results obtained using the frequency analyzer appear in FIG. 6A and FIG. 6B. FIG. 6A is the power spectrum for the whistle 1 of the first embodiment, and FIG. 6B is for the whistle of the reference example. The horizontal axes of the graphs indicate frequency (kHz), and the vertical axis indicate the power spectrum, that is, the sound wave energy.

In the case of the pea-type whistle 1 of the first embodiment, the first large-peak wave generating maximum sound volume is near 2750 Hz. And, as indicated by the dashed lines, large peaks appear with period approximately 2750 Hz. Also, a first small peak appears clearly between the first large peak and the second large peak. In addition, second, third, fourth, fifth, and sixth small peaks, thought to be multiples of the small peak, appear between the multiples of the large peak.

On the other hand, in the case of the whistle of the reference example, the first large peak is near 3313 Hz. And, as indicated by the dashed lines, large peaks appear with a period of approximately 3310 Hz.

In the case of the whistle 1 of the first embodiment, compared with the whistle of the reference example, the first large peak is approximately 560 Hz lower, and the other peaks are also shifted to the low-frequency side. This difference in frequency is clearly perceived by humans. Moreover, up to the limit of the human audible frequency range, which is 20 kHz, there are seven large peaks in the case of the whistle 1 of the first embodiment. On the other hand, there are six peaks for the whistle of the reference example. Moreover, in the case of the whistle 1 of the first embodiment there also exists a resonance sound wave near 10 kHz. In contrast, there is no resonance sound wave in this frequency range in the case of the whistle of the reference example. Moreover, hardly any unpleasant high harmonics at or above 15 kHz are produced by the whistle 1 of the first embodiment. In contrast, numerous such high harmonics are produced by the whistle of the reference example. Thus it was confirmed that the whistle-blowing sound of the pea-type whistle 1 of the first embodiment, in which a second resonance chamber is provided communicating with the first resonance chamber, is a pleasant whistle sound with richness in which disagreeable and unpleasant high harmonics are suppressed, resulting from shifting to the low-frequency side of the resonance frequency of the connected resonance chamber 20 comprising the first resonance chamber 21 and the second resonance chamber 22.

Embodiment 2

Figure 9B:
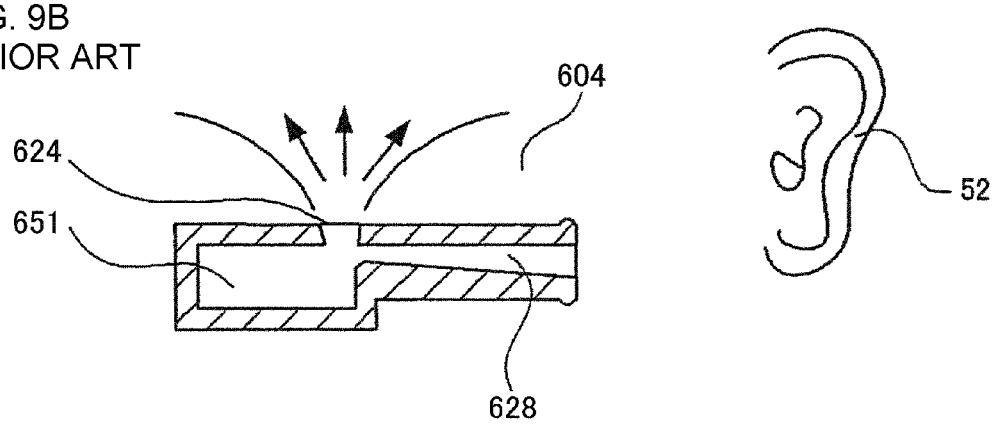
FIG. 9B PRIOR ART
FIG. 9B is a cross-sectional view of a pealess-type whistle of the prior art.

A pealess-type whistle 2 of the above second embodiment, having rectangular parallelepiped shape resonance chambers (height 6 mm, width 6 mm) with three different lengths and arranged horizontally in parallel, and as a reference example a whistle the same size as the pealess-type whistle 2 of the second embodiment but with the second resonance chamber removed, that is, similar to the whistle 604 shown in FIG. 9B, were fabricated, and the frequency characteristics of each were measured. And, examination to determine whether there was a shift to the low-frequency side of sound waves of the whistle of the second embodiment was performed. The heights of the second resonance chamber of the whistle 2 of the second embodiment were h=12 mm and h'=8.5 mm.

Similarly to Embodiment 1, a sound-level meter was installed at a position 1 m forward from each of the whistles in an anechoic chamber. Compressed air corresponding to human exhalation was supplied to the air opening from a compressor, and differences in sound quality due to the presence or absence of the second resonance chamber were measured. And, the sound-level meter output was analyzed using a frequency analyzer.

Figure 7A:
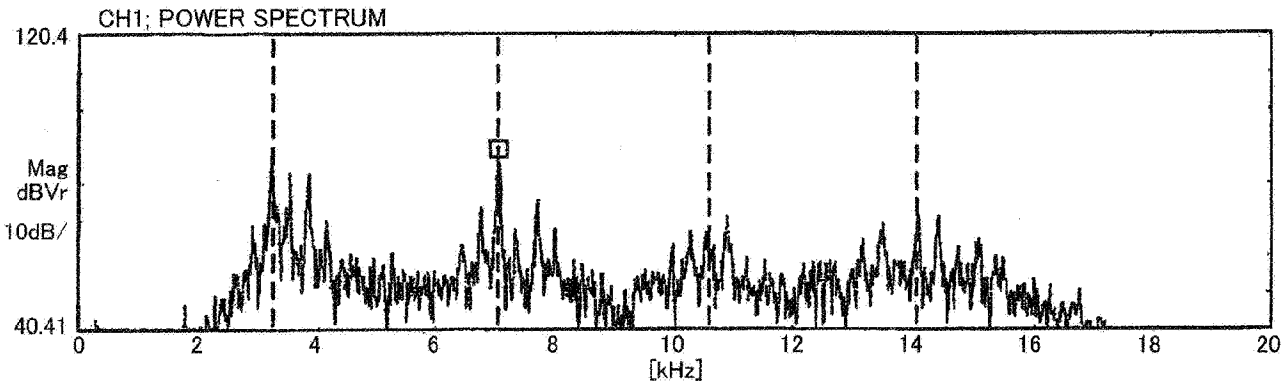
FIG. 7A is the power spectrum of the whistle of the second embodiment of the invention.
Figure 7B:
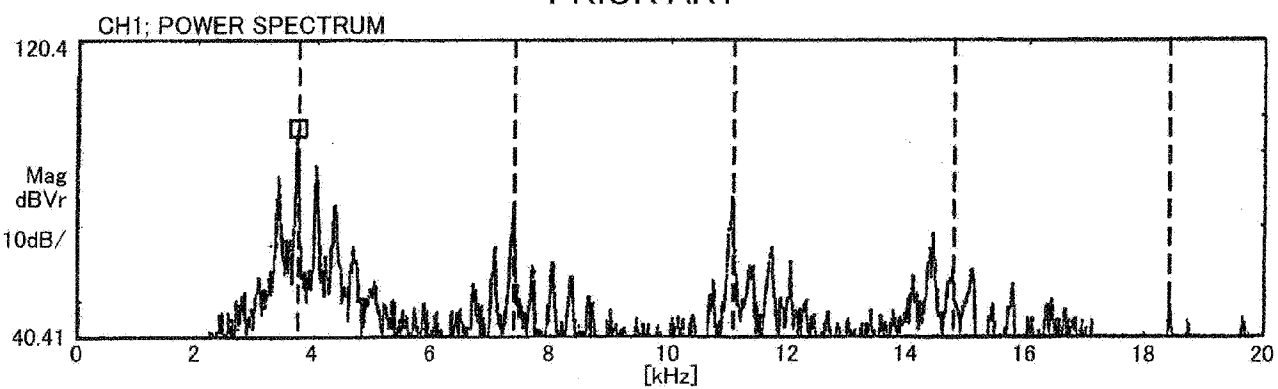
FIG. 7B PRIOR ART
FIG. 7B is the power spectrum of a whistle of the prior art.

The results appear in FIG. 7A and FIG. 7B. FIG. 7A is the power spectrum for the whistle 2 of the second embodiment, and FIG. 7B is the power spectrum for the whistle of the reference example. The horizontal axes of the graphs indicate frequency (kHz), and the vertical axis indicate the power spectrum, that is, the sound wave energy.

The measurement results indicated that, because of the three parallel resonance chambers as described above, the spectral waveform has a complex distribution. In the case of the pealess-type whistle of the second embodiment, a first large-peak wave generating the maximum sound volume exists near 3225 Hz, and a second large peak exists near 7038 Hz. On the other hand, the first large peak in the case of the reference example exists near 3688 Hz, and the second large peak exists near 7375 Hz. In the cases of both whistles, comparatively large peaks are distributed centered on the large peaks.

However, as is seen from the measurement results, the peak distribution is more complex for the whistle 2 of the second embodiment than for the whistle of the reference example. This is thought to be due to the second resonance chamber 22.

Also, the first large peak of the whistle 2 of the second embodiment is approximately 460 Hz lower than the first large peak of the reference example whistle, and the other peaks are also shifted to lower frequencies overall. This difference in frequencies is clearly perceived by humans. And, due to the complex resonance sounds, the whistle-blowing sound of the whistle 2 of the second embodiment is a sound with richness.

In this way, similarly to the pea-type whistle, it was confirmed that because a second resonance chamber communicating with the first resonance chamber is provided in the pealess-type whistle, the resonance frequencies of sound waves are shifted to the low-frequency side, resulting in a sound with richness, and unpleasant and disagreeable high harmonics are suppressed to result in a pleasing whistle sound.

Embodiment 3

The height h' on the front side and height h on the rear side of the second resonance chamber of the pealess-type whistle of the second embodiment were modified, and the effects of these heights on the drop in frequency were investigated. The height h' was made approximately 70% of the height h. The average height (h+h')/2 was set to 2 mm, 3 mm, 4 mm, 5 mm, 6.5 mm, 7 mm, 8 mm, 10 mm, 12 mm, 14 mm, and 17 mm. Using a sound-level meter similar to that in Embodiment 1, the whistle-blowing sounds of the whistles were measured, and the resonance frequency appearing at the lowest frequency was investigated in each case. The whistles used here were manufactured using a resin mold different from the whistles employed in Embodiment 2. For this reason the dimensions were somewhat different, and the resulting measurements obtained were somewhat different. This means that the resonance phenomena are physical phenomena which are sensitive to the dimensions, shape, and surface conditions of the air flow paths.

Figure 8:
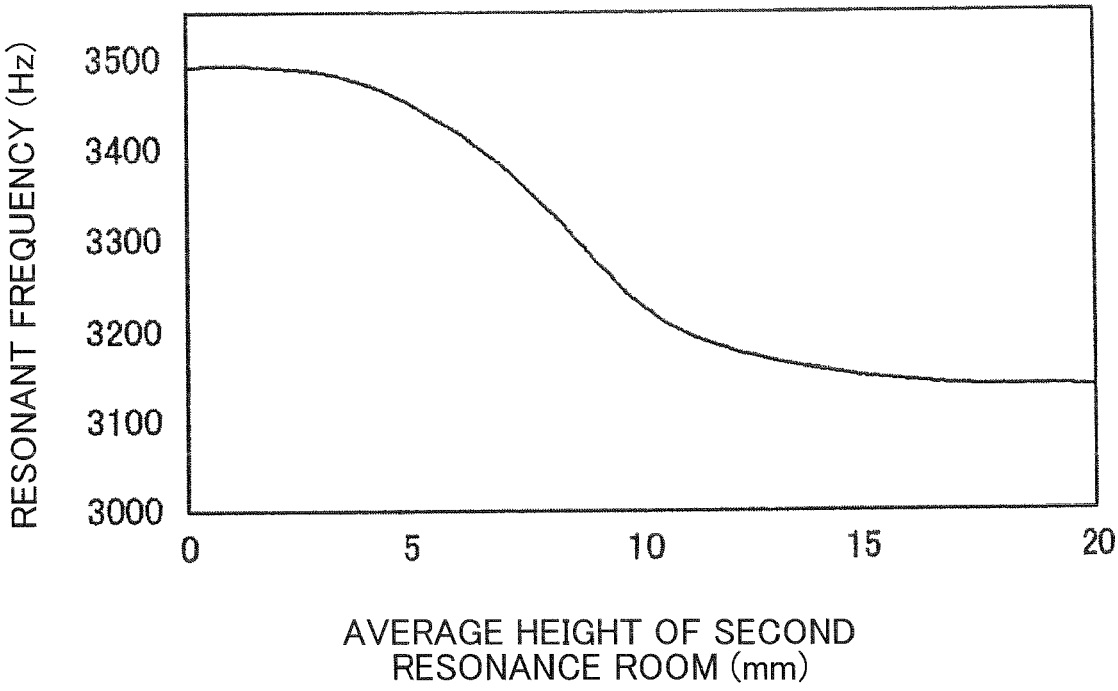
FIG. 8 is a graph showing the relation between the height of the second resonance chamber and frequency reduction in this invention.

The results appear in FIG. 8. Up until an average height for the second resonance chamber of 4 mm, the resonance frequencies were unchanged, in the vicinity of 3500 Hz.

However, when the average height was 5 mm, the resonance frequency was 3420 Hz, so that the frequency was lowered by 70 to 80 Hz compared with the case of an average height of 4 mm. And, as the average height increased from 5 mm, the resonance frequency further declined. At an average height of 14 mm, the resonance frequency was approximately 3150 Hz, or as much as 350 Hz lower than when the average height was 4 mm.

From these results, it is seen that in order to lower the frequency, obtain a sound with richness, and suppress unpleasant high-frequency noise, the height of the second resonance chamber should be made 5 mm or higher. Even if the height is made 15 mm or higher, significant further lowering of the frequency is not seen. Hence from the standpoint of small size and light weight, which are features desired in a whistle, it is preferable that the height of the second resonance chamber be from 5 mm to 15 mm.

As explained above, these embodiments present a whistle, comprising a mouthpiece portion inside which an air passageway is formed and in which an air opening is opened, and a body portion, in which a connected resonance chamber that is connected to the air passageway is formed; the connected resonance chamber comprises a first resonance chamber, a second resonance chamber in which a sound-emitting opening is opened, and an orifice connecting the first resonance chamber and the second resonance chamber.

By means of this whistle, resonances occur in the second resonance chamber in addition to the first resonance chamber. And, a portion of these sound waves reflects at the sound-emitting opening, and again pass through the orifice into the first resonance chamber, and further resonances occur in the connected resonance chamber comprising the first resonance chamber and the second resonance chamber. The wavelength of the sound waves due to this resonance is long, and the resonance frequency is lowered without excessive enlargement of the whistle. This enables suppression of shrill and unpleasant high-frequency sounds, as well as reduction of hardness of hearing and ringing in the ears of the whistle-blower.

Further, it is preferable that the mouthpiece portion be connected to substantially the center portion in the vertical direction of the body portion. By means of this configuration, when the mouthpiece portion is held in the mouth, the rear wall of the body portion can be made to function as a stopper for the upper lip.

Here, it is preferable that the body portion be inclined upwardly toward the mouthpiece portion. By means of this configuration, lengthening of the whistle in the front-rear direction can be avoided, while securing adequate volume for the body portion and for the connected resonance chamber.

Here, it is preferable that an axis of the body portion in a length direction be inclined upwardly toward the mouthpiece portion, and that the angle of intersection of the length-direction axis of the body portion and a length-direction axis of the mouthpiece portion be from 30° to 70°.

Further, it is preferable that the second resonance chamber be formed in the upper portion of the body portion, and that the first resonance chamber be formed in the lower portion of the body portion.

Further, it is preferable that the upper portion of the portion of the rear wall of the body portion forming the second resonance chamber be curved frontward. By means of this configuration, the direction of emission of sound waves from the second resonance chamber to the outside is directed forward, so that sound waves are emitted forward, and direct incidence of the sound waves on the ears of the whistle-blower is avoided. Moreover, sound waves directly reach listeners in front of the whistle-blower. Consequently, listeners can immediately recognize the whistle-blowing sound. Also, because sound waves are shifted to the low-frequency side, at which overall there is little attenuation and sounds reach far distances, even distant listeners can recognize the whistle-blowing sound.

Further, it is preferable that the sound-emitting opening be opened in the upper portion of the portion of the front wall of the body portion forming the second resonance chamber. By this means, the length to the sound-emitting opening in the second resonance chamber can be further lengthened. Moreover when the sound-emitting opening is opened to front and oblique direction, the sound waves are emitted to front and oblique direction.

Further, it is preferable that the height of the second resonance chamber from the lower end to the sound-emitting opening be for example 5 mm or greater, and less than 15 mm. By this means, the resonance frequency can be kept within the audible range, and the resonance frequency can be more reliably shifted to a lower frequency.

Further, it is preferable that the front wall of the body portion have a protruding portion which protrudes rearward in substantially the center portion in the vertical direction, and that the orifice be defined by this protruding portion and the rear wall of the body portion.

Further, it is preferable that the first resonance chamber have a substantially cylindrical shape.

This application is based on Japanese patent application No. 2008-119972 filed in Japan Patent Office on May 1, 2008, the contents of which are hereby incorporated by reference.

Although the present invention has been fully described by way of example with reference to the accompanying drawings, it is to be understood that various changes and modifications will be apparent to those skilled in the art. Therefore, unless otherwise such changes and modifications depart from the scope of the present invention hereinafter defined, they should be construed as being included therein.

What is claimed is:

1. A whistle, comprising:

a mouthpiece portion, inside which an air passageway is formed and in which an air opening is opened; and a body portion, in which a connected resonance chamber that is connected to the air passageway is formed, the body portion being inclined upwardly toward the mouthpiece portion and the mouthpiece portion being connected to a part of the body portion substantially in the center in a vertical direction, wherein the connected resonance chamber comprises a first resonance chamber, a second resonance chamber in which a sound-emitting opening is opened, and an orifice through which the first resonance chamber communicates with the second resonance chamber and wherein an axis of the body portion in a length direction is inclined upwardly toward the mouthpiece portion, and the angle of intersection of the axis of the body portion in the length direction and an axis of the mouthpiece portion in a length direction is 30° to 70°.

2. The whistle according to claim 1, wherein, in the second resonance chamber, the height from a lower end of the second resonance chamber to the sound-emitting opening is 5 mm or greater and less than 15 mm.

3. The whistle according to claim 1, wherein the first resonance chamber has a substantially cylindrical shape.

4. The whistle according to claim 1, wherein the second resonance chamber is formed in an upper portion of the body portion, and the first resonance chamber is formed in a lower portion of the body portion.

5. A whistle, comprising:

a mouthpiece portion, inside which an air passageway is formed and in which an air opening is opened; and a body portion, in which a connected resonance chamber that is connected to the air passageway is formed, the body portion being inclined upwardly toward the mouthpiece portion and the mouthpiece portion being connected to a part of the body portion substantially in the center in a vertical direction, wherein the connected resonance chamber comprises a first resonance chamber, a second resonance chamber in which a sound-emitting opening is opened, and an orifice through which the first resonance chamber communicates with the second resonance chamber, the second resonance chamber being formed in an upper portion of the body portion, and the first resonance chamber being formed in a lower portion of the body portion, and wherein an upper end of a portion forming the second resonance chamber at a rear wall of the body portion is curved frontward.

6. The whistle according to claim 5, wherein the sound-emitting opening is opened in an upper portion of a portion forming the second resonance chamber at a front wall of the body portion.

7. The whistle according to claim 5, wherein a front wall of the body portion has a protruding portion which protrudes rearward in substantially the center portion in the vertical direction, and the orifice is defined by the protruding portion and by a rear wall of the body portion.

8. The whistle according to claim 5, wherein an axis of the body portion in a length direction is inclined upwardly toward the mouthpiece portion, and the angle of intersection of the axis of the body portion in the length direction and an axis of the mouthpiece portion in a length direction is 30° to 70°.

9. The whistle according to claim 5, wherein, in the second resonance chamber, the height from a lower end of the second resonance chamber to the sound-emitting opening is 5 mm or greater and less than 15 mm.

10. The whistle according to claim 5, wherein the first resonance chamber has a substantially cylindrical shape.

11. A whistle, comprising:

a mouthpiece portion, inside which an air passageway is formed and in which an air opening is opened; and a body portion, in which a connected resonance chamber that is connected to the air passageway is formed, wherein the connected resonance chamber comprises a first resonance chamber, a second resonance chamber in which a sound-emitting opening is opened, and an orifice through which the first resonance chamber communicates with the second resonance chamber, and wherein the connected resonance chamber shifts the resonance frequency to a lower frequency.

12. The whistle according to claim 11, wherein the mouthpiece portion is connected to a portion of the body portion substantially in the center in a vertical direction.

13. The whistle according to claim 12, wherein the body portion is inclined upwardly toward the mouthpiece portion.

14. The whistle according to claim 13, wherein an axis of the body portion in a length direction is inclined upwardly toward the mouthpiece portion, and the angle of intersection of the axis of the body portion in the length direction and an axis of the mouthpiece portion in a length direction is 30° to 70°.

15. The whistle according to claim 13, wherein the second resonance chamber is formed in an upper portion of the body portion, and the first resonance chamber is formed in a lower portion of the body portion.

16. The whistle according to claim 11, wherein the sound-emitting opening is opened in an upper portion of a portion forming the second resonance chamber at a front wall of the body portion.

17. The whistle according to claim 11, wherein, in the second resonance chamber, the height from a lower end of the second resonance chamber to the sound-emitting opening is 5 mm or greater and less than 15 mm.

18. The whistle according to claim 11, wherein a front wall of the body portion has a protruding portion that protrudes rearward in substantially a center portion in a vertical direction, and the orifice is defined by the protruding portion and by a rear wall of the body portion.

19. The whistle according to claim 11, wherein the first resonance chamber has a substantially cylindrical shape.

20. The whistle according to claim 11, wherein an upper end of a portion forming the second resonance chamber at a rear wall of the body portion is curved forward.

* * * * *